US006836120B1

(12) United States Patent
Lite

(10) Patent No.: US 6,836,120 B1
(45) Date of Patent: Dec. 28, 2004

(54) AUTOMOTIVE IGNITION COIL TESTER

(76) Inventor: Steven Alan Lite, 166 Solano St., San Rafael, CA (US) 94901

( * ) Notice: Subject to any disclaimer, the term of this patent is extended or adjusted under 35 U.S.C. 154(b) by 0 days.

(21) Appl. No.: 10/359,502

(22) Filed: Feb. 5, 2003

(51) Int. Cl.[7] ..... F02P 17/00
(52) U.S. Cl. ..... 324/388; 308/402
(58) Field of Search ..... 324/388, 378, 324/380, 384, 393, 395, 396, 397, 398, 399, 122, 169, 402, 536; 123/605, 621, 634, 650, 406.57; 361/139, 155, 268

(56) References Cited

U.S. PATENT DOCUMENTS 3,806,796 A * 4/1974 Goldstein ..... 324/384
3,828,246 A * 8/1974 Maynard ..... 324/398
3,996,512 A * 12/1976 Baur ..... 324/533
4,020,413 A * 4/1977 Wetherbee ..... 324/383
4,186,337 A * 1/1980 Volk et al. ..... 324/380
4,490,799 A * 12/1984 Marino et al. ..... 701/102
5,194,813 A * 3/1993 Hannah et al. ..... 324/379
5,196,798 A * 3/1993 Baeza et al. ..... 324/388
6,123,058 A * 9/2000 Endou ..... 123/490
6,396,278 B1 * 5/2002 Makhija ..... 324/402
6,414,400 B1 * 7/2002 Scott et al. ..... 290/40 C
6,426,626 B1 * 7/2002 Kravis ..... 324/388
6,714,015 B2 * 3/2004 Whitehead ..... 324/378

* cited by examiner

*Primary Examiner*—N. Le
*Assistant Examiner*—Hoai-An D. Nguyen
(74) *Attorney, Agent, or Firm*—Risto A. Rinne, Jr.

(57) ABSTRACT

An apparatus for testing the actual functioning of an automotive coil includes a housing with a switch and a capacitor across the switch. Connections to ground and to a coil that is placed in series with the apparatus are provided. An opposite side of the coil either is or remains connected to a positive source of voltage, such as a battery in the automobile. The positive source of voltage is also connected to a visible spark tester. Cycling of the switch activates the coil and produces an arc that is visible in the spark tester. An additional circuit is provided in the housing that verifies the presence of a minimum required voltage.

11 Claims, 1 Drawing Sheet

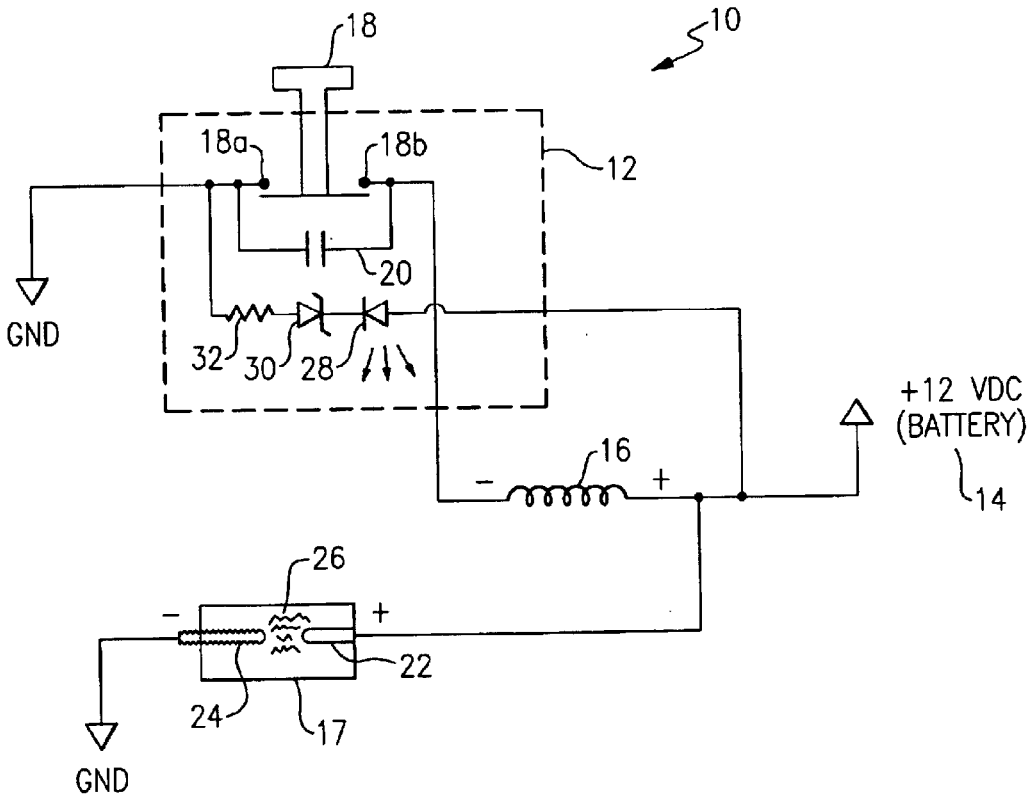
18
10
18a
18b
12
20
GND
32
30
28
+12 VDC
(BATTERY)
16
14
26
22
24
17
GND

AUTOMOTIVE IGNITION COIL TESTER

BACKGROUND OF THE INVENTION

1. Field of the Invention

The present invention, in general relates to automotive testers and, more particularly, to an automotive coil tester.

An automotive coil boosts the voltage sufficient for it to create a spark that arcs across a spark plug which, in turn, ignites the fuel-air mixture as is well known in the automotive arts.

Coils, like all component parts, are prone to failure. The normal way to test a coil is to use an ohm meter to test the resistance of the internal windings. If the resistance falls within a given range it is assumed that the coil is not defective.

However, it is possible for coils to "ohm out" with an acceptable resistance and still be defective. This creates an exasperating situation in which an automotive mechanic falsely believes that the problem cannot be due to a defective coil, because it ohms out properly, and therefore spends a great deal of time investigating and possibly even replacing other properly functioning component parts until all else has been exhausted. Finally in desperation, the mechanic may decide to replace the coil which then solves the problem.

As a result of a faulty test of the coil a great deal of time is spent troubleshooting and attempting repair in vain. Clearly, it is desirable to be able to ascertain with great accuracy whether a coil really is functioning properly.

Also, because coils can fail in a progressive manner in which they become weaker and weaker, it is not only desirable to determine whether or not a coil remains capable of boosting the voltage an amount sufficient to cause a spark to occur, but also determining how strong that spark is.

Whether or not the coil is removed from an automobile for testing, an additional variable exists. Is there sufficient voltage available to properly energize the coil? If for example the tester itself does not supply at least 9.0 volts to the coil, then the coil may fail to generate an adequate spark even if there is no defect in the coil itself.

Also, if the coil remains in the engine compartment during the test it will receive its power from the vehicle's battery. It is also possible that the coil itself is not defective but that, for some reason, adequate power is not being supplied to the coil. It is important to determine if this is the situation.

Accordingly there exists today a need for an automotive ignition coil tester that can verify with certainty whether or not a coil is defective.

Clearly, such an apparatus would be a useful and desirable device, especially if it could do so quickly and inexpensively.

2. Description of Prior Art

Coil tester are, in general, known and include the ohm meters previously mentioned. While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide an automotive ignition coil tester that is adapted to actuate a coil on demand.

It is also an important object of the invention to provide an automotive ignition coil tester that includes a push-button switch that can be depressed to actuate a coil.

Another object of the invention is to provide an automotive ignition coil tester that is adapted for use with a variable-length type of spark tester to determine the strength of spark that is produced.

Still another object of the invention is to provide an automotive ignition coil tester that includes circuitry for determining if a sufficient voltage is present to continue the test of the coil.

Still yet another object of the invention is to provide an automotive ignition coil tester that prevents the user from receiving a shock during testing.

Yet another important object of the invention is to provide an automotive ignition coil tester that is inexpensive to produce.

Still yet another important object of the invention is to provide an automotive ignition coil tester that provides a reliable indication of the state of functioning of an automotive coil.

Still one further object of the invention is to provide an automotive ignition coil tester that can be connected to a coil that is powered by a vehicle's power supply and which remains disposed in the engine compartment during testing.

Briefly, an automotive ignition coil tester that is constructed in accordance with the principles of the present invention has a housing containing circuitry that includes a momentary single pole switch and a capacitor (also known as a condenser) that is wired across the contacts of the switch. One end of the switch goes to ground and another positive side goes to one end of a coil and eventually to a positive voltage source that is above 9.0 VDC. A first branch off the circuit goes from the positive side of the coil to a variable length spark tester. A second branch off the circuit goes from the positive side of the coil to a LED through a zener diode and resistor whereby the LED is illuminated sufficient to see only if at least 9.0 VDC is present. In use, illumination of the LED is first verified. Then the variable length spark tester is adjusted for a minimum voltage spark. The momentary switch is depressed and released while the variable length spark tester is observed to determine if a minimum spark is present. If it is not, the coil is deemed to be defective. If a spark is observed, the gap in the variable length spark tester is increased and the test is repeated until a maximum length of spark (i.e., arc) is determined sufficient to assess the quality of the coil. Accordingly, a coil that passes the basic test of functioning can further be assessed as one that is marginal and replaced as desired.

BRIEF DESCRIPTION OF THE DRAWING

The FIGURE is a block diagrammatic view of a container and circuitry and peripheral connections of an automotive ignition coil tester.

DETAILED DESCRIPTION OF THE INVENTION

Referring to the FIGURE is shown, an automotive ignition coil tester, identified in general by the reference numeral 10.

A housing 12 contains various component parts as are described in greater detail hereinafter. The housing 12 is not limited to contain only those component parts that are described as being contained therein but the housing 12 can include additional component parts, for example even a battery 14, and additional connections not presently shown, some of which are currently shown as being external to the housing 12.

These and other variations are intended to include normal design flexibility that those having ordinary skill in the art of designing automotive testing devices can accomplish once they have had benefit of the instant disclosure.

Also, the various connections to the housing 12, a coil 16, a variable length spark tester 17, and to a voltage positive and negative (i.e., ground) source are shown as being electrically connected but the means for connection are not specifically shown and are intended to include any type of clip or alligator clip or post and terminal, or pin and socket or other type of electrical connector as are well known in the test equipment arts.

These physical connections may include any number of terminals or connectors that are mounted on the housing 12, as desired, to simplify the process of connecting the coil 16 for testing to the automotive ignition coil tester 10.

While the automotive ignition coil tester 10 may be used as a "bench tester" in which the coil 16 is removed from the vehicle (not shown) and tested, it is preferable to retain the coil 16 in the engine compartment and test it there, making the necessary connections as shown. There are two advantages to leaving the coil 16 in the engine compartment. The first is that it simply is faster to do so. The second is because testing the coil 16 in this manner also tests the voltage (i.e., electrical power) that the vehicle is supplying to the coil 16, as is described in greater detail hereinafter.

Accordingly, the test becomes a truly functional test of the coil's 16 abilities to properly perform in the automobile and, as a result, the coil 16 can either be positively determined as being defective or it can positively be ruled out as a problem source. Either way, very useful information is obtained.

Prior to use of the automotive ignition coil tester 10, all electrical connections are made as shown in the drawing FIGURE. The connections of components that are contained within the housing 12 are pre-wired. Therefore only the external connections to the coil 16, battery 14 positive and negative, and to the spark tester 17 are required prior to use of the automotive ignition coil tester 10.

The housing 12 contains a switch 18, preferably a normally closed single pole momentary switch.

A capacitor 20 (also known as a condenser in the automotive arts) is also contained in the housing 12 and is electrically connected across the contacts of the switch 18. The capacitor 20 retards sudden changes in voltage from appearing across the switch 18. This is similar to the purpose and function of a condenser (not shown) that is places across the contacts of a set of automotive points (not shown).

A negative side 18*a* of the switch 18 is electrically connected to ground (i.e., negative side of the battery 14).

A positive side 18*b* of the switch 18 is electrically connected to a negative side of the coil 16. An opposite positive side of the coil 16 is electrically connected to 12 VDC (i.e., positive side of the battery 14).

Accordingly, a circuit from positive voltage, through the coil 16, through the switch 18, and to ground is provided when the switch 18 is released and is in the normally closed position sufficient to charge the coil 16.

When the switch 18 is depressed, the circuit is broken and current flow is instantaneously interrupted. The property of the coil 16, which is an inductor, is to resist instantaneous changes in current flow. Therefore, the coil 16 will boost voltage sufficient to retain current flow, exactly the same as is done in an automobile (not shown) that is running.

The capacitor 20 prevents this change from instantaneously appearing across the contacts 18*a*, 18*b* of the switch 18. Therefore, no arc can occur across the switch 18 that would deplete the energy in the coil 16.

This produces a rise in voltage at the positive side of the coil 16 which also appears on the positive side of the spark tester 17.

The spark tester 17 includes a first terminal 22, either the positive or negative, that is fixed in position. A second terminal 24 is threaded and can be urged closer to or further away from the first terminal 22. As shown, the first terminal 22 is positive and the second terminal 24 is negative and connected to ground.

To use the automotive ignition coil tester 10, the second terminal 24 is initially urged (i.e., screwed) in toward the first terminal 22 to a minimum distance that corresponds with a "weak spark". That exact distance depends upon the atmosphere (i.e., the gas) that is in the spark tester 17 and is therefore subject to change from one spark testing device to another. It is different, for example, in humid or dry air as it is different in a partial vacuum, or in some other gas.

Therefore, when the switch 18 is depressed sufficient to break the circuit, the resultant rise in voltage that is produced by the coil 16 appears at the first terminal 22 of the spark tester 17.

If the coil 16 is able to produce even a weak spark, that spark will be visible through a glass enclosure of the spark tester 17 as an arc 26 that is produced intermediate the first terminal 22 and the second terminal 24.

Assuming that the automotive ignition coil tester 10 has been properly connected and that a sufficient voltage is present, the absence of the arc 26 would indicate that the coil 16 is defective and unable to produce even a weak spark. Verification of the proper voltage is discussed in greater detail hereinafter.

Therefore, the coil 16 would be replaced if no arc 26 is observed. Accordingly, a dynamic method of testing the coil 16 under a "real life" condition that is removed from the automobile is provided.

Furthermore, the user is protected and never receives an electrical shock from use of the device. It is all too well known in the automotive arts that the output of the coil 16 is capable of producing a painful, even dangerous, electrical shock. The automotive ignition coil tester 10 prevents the user from receiving such a shock while testing the coil 16 in a manner that absolutely determines whether or not it can generate a voltage rise sufficient to produce a spark.

If a sufficiently weak spark (i.e., arc 26) is observed, the strength of the arc 26 can be verified by progressively urging the second terminal 24 of the spark tester 17 further away from the first terminal 22 and repeating the test (i.e., observing the spark tester 17 while depressing the switch 18).

This process is repeated until the arc 26 either ceases or becomes intermittent. In this manner, the quality of the arc 26 can be determined from an extreme of having no arc 26 at all 26 to having a weak arc 26 (moderate increase in the distance between the first and second terminals 22, 24) to having a strong arc 26 (large increase in the distance between the first and second terminals 22, 24).

Therefore, not only is the functioning of the coil 16 determined, and quickly, but its quality is further verified.

As mentioned hereinbefore, it is important to ensure that the voltage that is supplied to the coil 16 is sufficient to energize the coil 16 or a false conclusion that the coil 16 is defective can be made when in fact an insufficient voltage is the problem.

To correct this, a light emitting diode 28 (hereinafter LED 28) that provides illumination in the visible bandwidth of light is included in the housing 12, mounted in such manner that the illumination can be observed when the LED 28 is illuminated.

The LED 28 includes a positive side that is electrically connected to positive 12 VDC. A negative side of the LED 28 is connected to a positive side of a zener diode 30. A negative side of the zener diode 30 is connected to a positive side of a resistor 32. A negative side of the resistor 32 is connected to ground.

If the voltage supplied is sufficient to overcome the resistance of the zener diode 30, the zener diode 30 will collapse and allow current flow through it to occur. The resistor 32 is chosen so as to limit the magnitude of current flow through the LED 28 to a safe level for proper operation when current is flowing through the zener diode 30.

The LED 28, zener diode 30, and resistor are selected so as to illuminate the LED 28 sufficient to see that it is illuminated only if the voltage provided by the battery 14 is at least 9.0 volts. If the voltage is less than 9.0 volts DC, the zener diode 30 will not allow current flow to occur through it and the LED 28 will not illuminate.

The reason 9.0 VDC is chosen, is because this voltage which is less than the twelve volts the battery 14 produces, is a better indicator of what the coil 16 may experience when it is back in the automobile. If there is at least 9.0 volts being applied to the coil 16 and the arc 26 is good, then there is very high probability that any problem in ignition is not due to any defect in the coil 16. If the automobile supplies an even greater voltage to the coil 16, then its performance can only be further improved.

It is also mentioned that the spark tester 17 has been referred to also as a variable length spark tester. The variable length aspect refers to the fact that the distance between the first and second terminals 22, 24 can be varied and therefore the "length" of the arc 26 that is produced can also be varied and readily observed. The spark tester 17 is an existing commercially available device that can be included in the housing 12, if desired, or externally connected as shown.

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto. For example, the various component parts can be configured or wired in various ways.

What is claimed is:

1. An automotive ignition coil tester adapted for testing an automotive ignition coil, comprising:

(a) a housing;

(b) circuit means included in said housing including a switch and a capacitor disposed across said switch; and (c) means for connecting said circuit means to said coil and to a battery and to a spark tester, (d) means for verifying that at least a minimum voltage is provided to said tester and to said coil and wherein said minimum voltage is adapted to indicate a voltage of said battery and wherein said battery provides electrical power to said coil and wherein said means for verifying includes means for providing a visible indication that a voltage greater than nine volts DC is present at said tester and at said coil prior to testing said coil;

wherein when said switch is cycled from a closed position into an open position and said coil is properly functioning, a visible arc is produced across said spark tester subsequent to each cycling of said switch.

2. The automotive ignition coil tester of claim 1 wherein said circuit means includes a capacitor that is disposed across a pair of contacts of said switch.

3. The automotive ignition coil tester of claim 1 wherein said switch is a single pole switch.

4. The automotive ignition coil tester of claim 1 wherein said switch is a normally closed type of switch.

5. The automotive ignition coil tester of claim 1 wherein said housing prevents a user from receiving an electrical shock during use.

6. The automotive ignition coil tester of claim 1 wherein said means for providing a visible indication includes a light emitting diode.

7. The automotive ignition coil tester of claim 6 wherein said means for providing a visible indication includes a zener diode in series with said light emitting diode wherein a current is permitted to flow through said zener diode and said light emitting diode only when said voltage is at least 9.0 volts DC.

8. The automotive ignition coil tester of claim 7 including a resistor that is in series with said zener diode and said light emitting diode and wherein said resistor is adapted to limit current through said light emitting diode to a safe operating level.

9. The automotive ignition coil tester of claim 1 wherein said spark tester is adapted to provide a visible indication of said arc intermediate a first and a second terminal.

10. The automotive ignition coil tester of claim 9 wherein said spark tester is adapted to vary the length of said arc.

11. A method for determining the condition of an automotive coil, comprised of the steps of:

(a) disconnecting an electrical output of a coil from an automobile;

(b) providing an automotive coil tester that includes;

(1) a housing;

(2) circuit means included in said housing including a switch and a capacitor disposed across said switch; and (3) means for connecting said circuit means to said coil and to a battery and to a spark tester, (4) means for verifying that at least a minimum voltage is provided to said tester and to said coil and wherein said minimum voltage is adapted to indicate a voltage of said battery and wherein said battery provides electrical power to said coil and wherein said means for verifying includes means for providing a visible indication that a voltage greater than nine volts DC is present at said tester and at said coil prior to testing said coil;

wherein when said switch is cycled from a closed position into an open position and said coil is properly functioning, a visible arc is produced across said spark tester subsequent to each cycling of said switch;

(c) attaching said automotive coil tester to said electrical output of said coil, to said spark tester, and to a direct current source of voltage;

(d) urging said switch from a closed position into an open position; and (e) observing said spark tester for the presence of an arc.

* * * * *